US008142335B1

(12) United States Patent
Leach et al.

(10) Patent No.: US 8,142,335 B1
(45) Date of Patent: Mar. 27, 2012

(54) SPRING COLLARS HAVING PERMANENT MAGNETS FOR NON-USE STORAGE

(75) Inventors: Justin James Leach, Phoenix, AZ (US); Chad Gordon Fuller, Phoenix, AZ (US); Edward Kazor, Highlands Ranch, CO (US); Patrick Aaron Sidener, Phoenix, AZ (US)

(73) Assignee: Emberstone Technologies, LLC, Phoenix, AZ (US)

( * ) Notice: Subject to any disclaimer, the term of this patent is extended or adjusted under 35 U.S.C. 154(b) by 0 days.

(21) Appl. No.: 12/749,411

(22) Filed: Mar. 29, 2010

Related U.S. Application Data

(60) Provisional application No. 61/164,873, filed on Mar. 30, 2009.

(51) Int. Cl.
*A63B 21/075* (2006.01)
*A63B 23/16* (2006.01)
*A63B 71/00* (2006.01)

(52) U.S. Cl. ..... 482/107; 482/49; 482/139

(58) Field of Classification Search ..... 482/49, 482/50, 106–108, 127, 139; 24/509, 510
See application file for complete search history.

(56) References Cited

U.S. PATENT DOCUMENTS

| | | | | | |
|---|---|---|---|---|---|
| 708,242 | A * | 9/1902 | Moseley | 482/49 |
| 3,290,043 | A * | 12/1966 | Sorensen | 482/49 |
| 4,569,105 | A | 2/1986 | Weider | |
| D287,387 | S | 12/1986 | Oliver et al. | |
| 4,639,979 | A | 2/1987 | Polson | |
| 5,060,934 | A * | 10/1991 | Winston | 482/49 |
| 5,087,032 | A * | 2/1992 | Gresh | 482/50 |
| 5,163,887 | A | 11/1992 | Hatch | |
| 5,295,933 | A | 3/1994 | Ciminski et al. | |
| 5,348,522 | A | 9/1994 | Brotman | |
| 5,472,400 | A * | 12/1995 | Royer | 482/141 |
| 5,666,702 | A * | 9/1997 | Ming-Chieh | 24/510 |
| 5,735,777 | A | 4/1998 | Benoit et al. | |
| 6,007,268 | A | 12/1999 | Whittington et al. | |
| 6,189,542 | B1 * | 2/2001 | Shepard | 132/273 |
| 7,789,814 | B1 * | 9/2010 | Xu | 482/107 |
| 7,841,970 | B2 * | 11/2010 | Striar et al. | 482/93 |
| 2003/0017919 | A1 | 1/2003 | Lanoue | |
| 2007/0167288 | A1 * | 7/2007 | Lin | 482/49 |
| 2007/0298940 | A1 | 12/2007 | Anderson | |
| 2009/0325769 | A1 * | 12/2009 | Miskel | 482/107 |

* cited by examiner

*Primary Examiner* — Allana Lewin

(57) ABSTRACT

To satisfy one or more of the foregoing objectives, embodiments of a spring collar are provided for removably securing a disc weight to the sleeve of a barbell. In one embodiment, the spring collar includes a resilient wire form having a permanent magnet mounted thereto. The spring collar includes a coiled body having a central aperture, and first and second radial arms extending from the coiled body. The first and second radial arms can be moved toward one another to increase the diameter of the central aperture and permit a user to slide the coiled body over the sleeve. The permanent magnet enables a user to removably secure the spring collar to a ferromagnetic surface when the spring collar is not in use.

14 Claims, 7 Drawing Sheets

SPRING COLLARS HAVING PERMANENT MAGNETS FOR NON-USE STORAGE

CROSS-REFERENCES TO RELATED APPLICATIONS

This Application claims priority to U.S. Provisional Application Ser. No. 61/164,873, filed Mar. 30, 2009, the contents of which are hereby incorporated by reference.

TECHNICAL FIELD

The present invention relates generally to exercise equipment and, more particularly, to embodiments of a spring collar including at least one permanent magnet enabling a user to removably secure the spring collar to a ferromagnetic surface when the spring collar is not in use.

BACKGROUND

An adjustable-weight barbell is an exercise bar onto which a number of modular disc weights (commonly referred to as "plates") can be removably loaded by a user. Several forms of adjustable-weight barbells are known and commercially available. One well-known barbell (commonly referred to as an "Olympic bar") assumes the form of a straight bar approximately 5-7 feet in length that is often utilized to perform bench press, military press, squat, and dead lift exercises. Another known barbell (commonly referred to as an "EZ curl bar") has an undulating shape, is approximately 3-4 feet in length, and is typically utilized to perform exercises such as bicep curls, upright rows, and triceps extensions. Other known types of adjustable-weight barbells include triceps bars (also referred to as "hammer curl" bars) and hex bars (also referred to as "trap bars"). Regardless of its particular form, an adjustable-weight barbell typically includes first and second outer sleeves, which are joined to opposing ends of a central bar or frame. Each sleeve is cylindrical in shape and sized to be matingly received through the central opening of one or more disc weights. If the adjustable-weight barbell is intended to be utilized in conjunction with "Olympic" sized disc weights, each sleeve is typically approximately 2 inches in diameter; and, if the barbell is intended to be utilized in conjunction with "standard" sized disc weights, each sleeve is typically approximately 1 inch in diameter.

When utilizing an adjustable-weight barbell of the type described above, a user first slides one or more disc weights onto each sleeve to bring the loaded barbell to a desired weight. After adding the desired number of disc weights, the user then slides a collar onto each sleeve to help secure the disc weights in place thereby increasing the stability of the barbell and decreasing the likelihood of injury during the subsequent exercise. Although several different types of collars are commercially available, spring collars (also commonly referred to as "spring clips") are the most widely utilized in both commercial and home gyms. A conventional spring collar typically includes a coiled body having a central aperture therethrough and two radial arms extending therefrom. When the spring collar is in a non-deflected state, the radial arms are angularly spaced apart from one another, and the central aperture has a diameter slightly less than the outer diameter of the barbell sleeve. When the radial arms are squeezed together, the coiled body deflects and the diameter of the central aperture increases to enable the spring collar to be slid over the sleeve with relative ease. To secure one or more disc weights to the barbell's sleeve, a user first loads the desired number of disc weights onto the sleeve, grasps the spring collar by its radial arms, squeezes the radial arms together, slides the coiled body over the sleeve and against the outermost disc weight, and then releases the spring collar's radial arms to allow the coiled body to contract around, and thus frictionally engage, the barbell's sleeve.

It is in the interest of commercial gyms to encourage their patrons to utilize spring collars and other safety equipment. To promote the usage of spring collars, many commercial gyms supply at least one set of spring collars for each piece of exercise equipment that supports an adjustable-weight barbell, such as a bench press, preacher curl, military press, or squat cage. However, rarely is there provided a convenient place or manner in which to store a pair of spring collars on or near a piece of exercise equipment when the exercise equipment is not in use. As a result, spring collars are frequently placed on the gym floor where the spring collars may be inadvertently moved, may be damaged, and pose a potential tripping hazard. Furthermore, when placed on the gym floor, a set of spring collars is not prominently visually displayed near each piece of exercise equipment, which decreases the likelihood of future use of the spring collars.

BRIEF SUMMARY

In view of the foregoing section entitled "Background," there exists an ongoing need to provide embodiments of a spring collar that may be conveniently stored on a piece of exercise equipment, such as a bench press or squat cage, when the spring collar is not in use. Ideally, embodiments of such a spring collar would permit a user to removably secure the spring collar to a piece of exercise equipment in a visually prominent manner to encourage usage of the spring collar by subsequent users. It would also be desirable if embodiments of such a spring collar increased user convenience by enabling a user to temporarily set aside the spring collar at a convenient elevated location, and thus free both hands, when loading or unloading relatively heavy discs weights from an adjustable-weight barbell. Other desirable features and characteristics of embodiments of the present invention will become apparent from the subsequent Detailed Description and the appended Claims, taken in conjunction with the accompanying Drawings and the forgoing Background.

To satisfy one or more of the foregoing objectives, embodiments of a spring collar are provided for removably securing a disc weight to the sleeve of a barbell. In one embodiment, the spring collar includes a resilient wire form having a permanent magnet mounted thereto. The resilient wire form includes a coiled body having a central aperture, and first and second radial arms extending from the coiled body. The first and second radial arms can be moved toward one another to increase the diameter of the central aperture and permit a user to slide the coiled body over the sleeve. The permanent magnet enables a user to removably secure the spring collar to a ferromagnetic surface when the spring collar is not in use.

Embodiments of a sleeve are also provided for use in conjunction with a spring collar of the type that includes a coiled body. In one embodiment, the sleeve includes an annular band configured to be disposed around the coiled body, and a permanent magnet mounted to the annular band. The permanent magnet enables a user to removably secure the spring collar to a ferromagnetic surface when the spring collar is not in use.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description. As appearing herein, the phrase "permanent magnet" is defined to include any structural element or assemblage of structural elements that retains a magnetic field in the absence of an inducing field or current, including composite magnets, rare earth magnets, polymer-bonded magnets, and magnetic assemblies. The phrase "ferromagnetic surface" is defined herein to include any surface or body to which a permanent magnet is attracted including, but not limited to, steel beams and other structural members of the type commonly utilized in the manufacture of exercise equipment.

Figure 2:
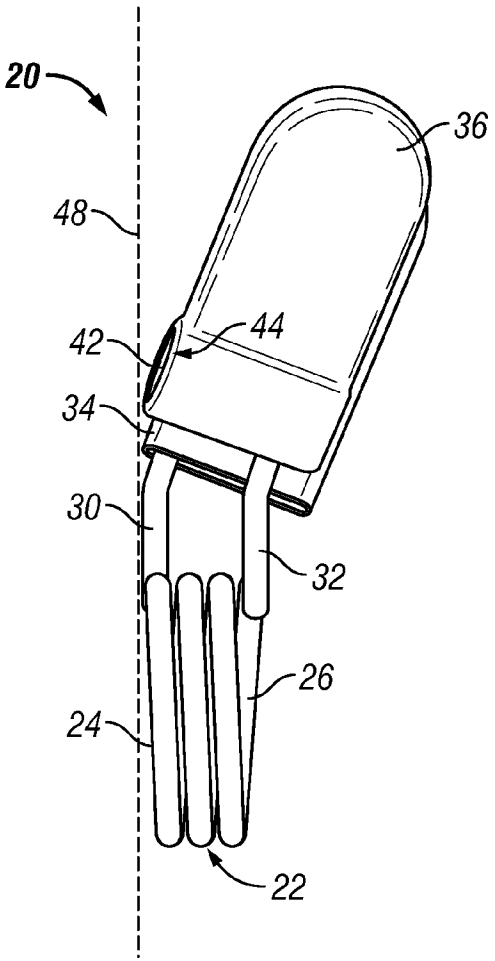
FIGS. 1 and 2 are isometric and side views, respectively, of a spring collar including a cover having a permanent magnet mounted thereto in accordance with an exemplary embodiment.
Figure 1:
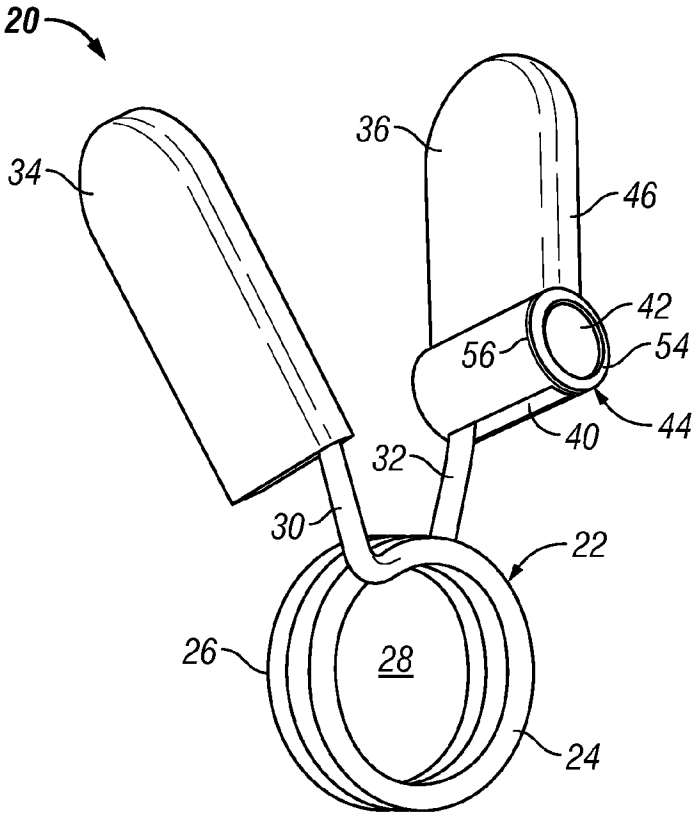

FIGS. 1 and 2 are isometric and side views, respectively, of a spring collar 20 in a non-deflected state in accordance with an exemplary embodiment of the present invention. Spring collar 20 includes a coiled body 22 having a substantially annular leading face 24, a substantially annular trailing face 26, and a central aperture 28 therethrough. A leading radial arm 30 is joined to a first end of coiled body 22 proximate leading face 24, and a trailing radial arm 32 is joined to a second, opposing end of coiled body proximate trailing face 26. Leading radial arm 30 and trailing arm 32 each extend radially outward from coiled body 22 and are angularly spaced apart when spring collar 20 resides in the non-deflected state shown in FIGS. 1 and 2. Leading radial arm 30 and trailing arm 32 can, however, be moved toward one another by a user to deflect coiled body 22, increase the diameter of central aperture 28, and enable spring collar 20 to be slid onto or off of the sleeve of an adjustable-weight barbell, as described more fully below in conjunction with FIG. 4.

Coiled body 22, leading radial arm 30, and trailing radial arm 32 are conveniently, although not necessarily, formed as a single resilient wire form piece. For this reason, coiled body 22, leading radial arm 30, and trailing radial arm 32 may be collectively referred to herein as "resilient wire form 22, 30, 32." Spring wire alloys suitable for usage in the formation of resilient wire form 22, 30, 32 include, but are not limited to, 300 series stainless steel, high carbon spring steel, oil-tempered chrome silicon, oil-tempered chrome vanadium, hard-drawn MB, and the like. In one specific embodiment, wire form 22, 30, 32 is formed from music wire bearing American Society for Testing and Materials ("ASTM") designation A-228. For corrosion resistance and aesthetic purposes, a chrome, zinc, or other plating can be applied over resilient wire form 22, 30, 32 utilizing, for example, an electroplating technique.

Figure 3:
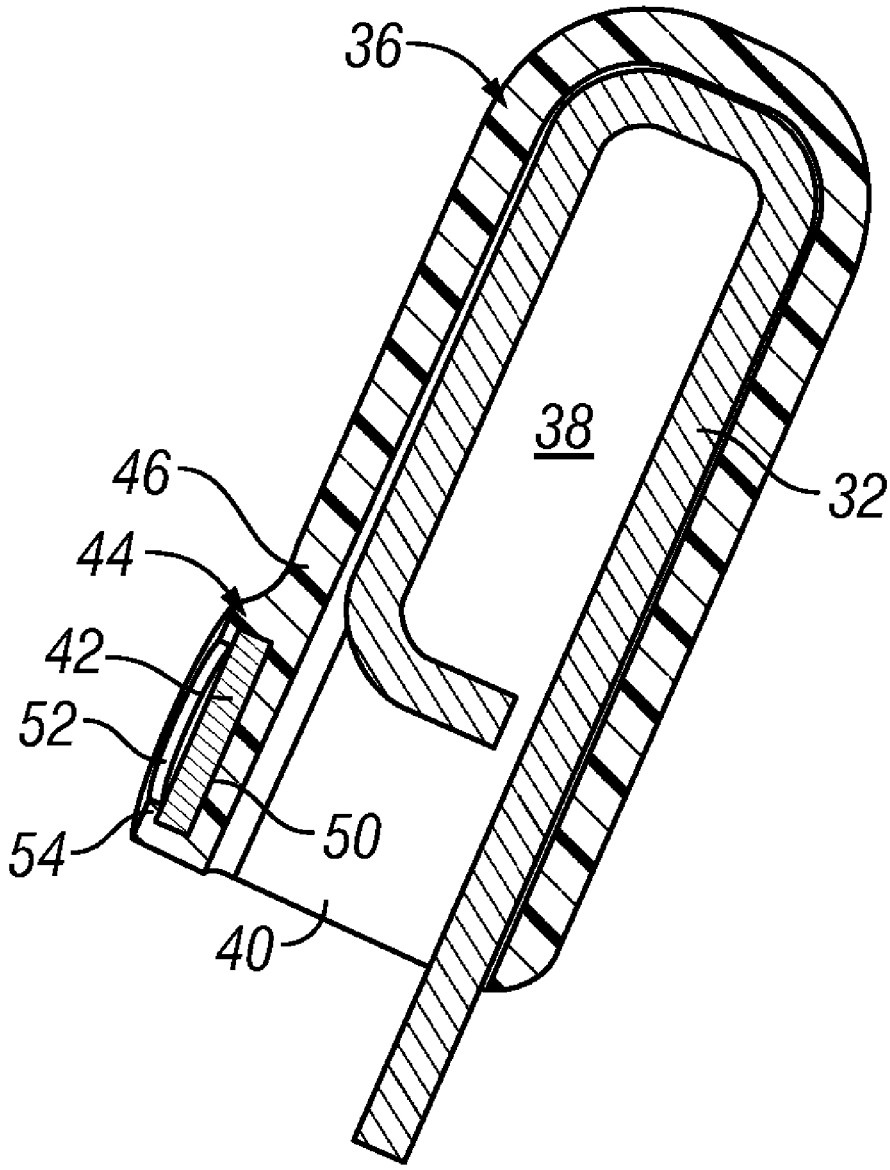
FIG. 3 is a cross-sectional view of the cover, the permanent magnet, and a distal portion of the trailing radial arm of the exemplary spring collar shown in FIGS. 1 and 2.

First and second covers 34 and 36 are disposed over radial arms 30 and 32, respectively. Covers 34 and 36 are conveniently formed from at least one durable, semi-flexible material, such as a relatively dense rubber or plastic. In the illustrated example, covers 34 and 36 are initially produced utilizing an injection molding process and subsequently press-fit over arms 30 and 32. This may be more fully appreciated by referring to FIG. 3, which is a cross-sectional view through cover 36 and a distal portion of trailing radial arm 32. As can be seen in FIG. 3, a cavity 38 having a geometry substantially conformal with radial arm 32 is formed within cover 36, and an opening 40 is formed through the lower end of cover 36. When cover 36 is press-fit over trailing radial arm 32, radial arm 32 extends through opening 40 and frictionally contacts the inner walls of cavity 38 to help retain cover 36 on spring collar 20. Cover 34 is likewise provided with an inner cavity substantially identical to cavity 38, and may be press-fit over trailing radial arm 30 in a similar manner. The foregoing example notwithstanding, covers 34 and 36 can be disposed over or mounted to radial arms 30 and 32 in various other manners; e.g., in certain embodiments, covers 34 and 36 can be molded directly over radial arms 30 and 32, respectively, utilizing an insert molding process.

One or more permanent magnets are mounted to resilient wire form 22, 30, 32 to enable collar 20 to be removably secured to a ferromagnetic surface (e.g., the steel sidewall of a bench press or other piece of exercise equipment) when the spring collar 20 is not in use. In one group of embodiments, one or more permanent magnets are mounted to leading radial arm 30 via attachment to cover 34 and/or mounted to trailing radial arm 32 via attachment to cover 36. In the exemplary embodiment illustrated in FIGS. 1-3, specifically, a permanent disc magnet 42 is mounted to a mounting structure 44 provided on a lower leading edge portion 46 of cover 36 (identified in FIG. 3). Mounting structure 44 may comprise a generally cylindrical protrusion that extends from leading edge portion 46 toward, but preferably does not extend beyond, the leading plane of spring collar 20 (represented in FIG. 2 by dashed line 48). As identified in FIG. 3, mounting structure 44 includes an annulus or cavity 50 in which disc magnet 42 resides, and a front-facing aperture 52 that exposes disc magnet 42 through structure 44 to minimize the magnetic shielding thereof. To provide protection from breakage, disc magnet 42 is preferably recessed within mounting structure 44. In addition, mounting structure 44 may be formed to include a circumferential rim or lip 54, which extends radially inward from the main body of structure 44 proximate aperture 52 to overlay an outer annular portion of disc magnet 42. By overlaying an outer annular portion of disc magnet 42 in this manner, circumferential lip 54 provides further protection from breakage and helps to retain magnet 42 within mounting structure 44 during usage of spring collar 20.

In certain embodiments, the dimensions of mounting structure 44, and specifically the diameter of aperture 52, may be selected to allow disc magnet 42 to be press-fit through aperture 52 and into cavity 50 (FIG. 3) during assembly of spring collar 20. In this case, an epoxy or other adhesive may be employed to help retain disc magnet 42 within cavity 50 (FIG. 3). In further embodiments, cover 36 and mounting structure 44 may be injection molded around disc magnet 42 utilizing an insert molding process, although the elevated temperatures associated with insert molding may limit the types of magnets suitable for use as disc magnet 42, as described more fully below. In still further embodiments, cover 36 and mounting structure 44 may initially be formed via injection molding, and disc magnet 42 may later be inserted into cavity 50 through a secondary opening provided in mounting structure 44; e.g., as shown in FIG. 1, a slot 56 may be formed in a sidewall of mounting structure 44 through which disc magnet 42 can be press-fit during assembly of spring collar 20.

Disc magnet 42 may comprise any type of magnet or magnetic assembly having a magnetic force sufficient to hold spring collar 20 against a vertical ferromagnetic surface, such as the steel sidewall of a bench press or other piece of exercise equipment. To ensure that spring collar 20 is held securely against such a vertical ferromagnetic surface without slippage, it is desirable that disc magnet 42 produces a relatively strong magnetic pull force, considering the dimensions of magnet 42, the weight of spring collar 20, and the width of the air gap between magnet 42 and a ferromagnetic surface when circumferential lip 54 is flush against the ferromagnetic surface. Furthermore, due to the potentially high impact usage of spring collar 20, it is also desirable that disc magnet 42 is relatively durable and resistant to chipping, cracking, and fracture. Thus, while composite magnets (e.g., ceramic magnets, ferrite magnets, aluminum-nickel-cobalt magnets, etc.) and polymer-bonded magnets (e.g., injection molded and flexible magnets) are by no means excluded from usage, it is generally preferred that a rare earth magnet, such as a neodymium or samarium cobalt magnet, is selected for use as disc magnet 42. Relative to samarium cobalt magnets, neodymium magnets tend to be less costly, to have higher magnetic strengths, and to be less prone to fracture; thus, in many applications, neodymium magnets will be preferred over samarium cobalt magnets. However, in embodiments wherein disc magnet 42 is exposed to elevated temperatures during manufacture, such as when cover 36 is insert molded around magnet 42, samarium cobalt magnets may be preferred; relative to neodymium magnets, samarium cobalt magnets have considerably higher temperature tolerances (e.g., higher operational temperatures and Curie temperatures) and are consequently less likely to suffer a permanent loss in magnetism when subjected to elevated temperatures during the insert molding process, although the re-magnetization of disc magnet 42 after insert molding is by no means excluded as a possible manufacturing technique. In many embodiments, disc magnet 42 will be coated with one or more layers of nickel, copper, gold, epoxy, or like material to provide corrosion resistance and/or increased durability.

Figure 4:
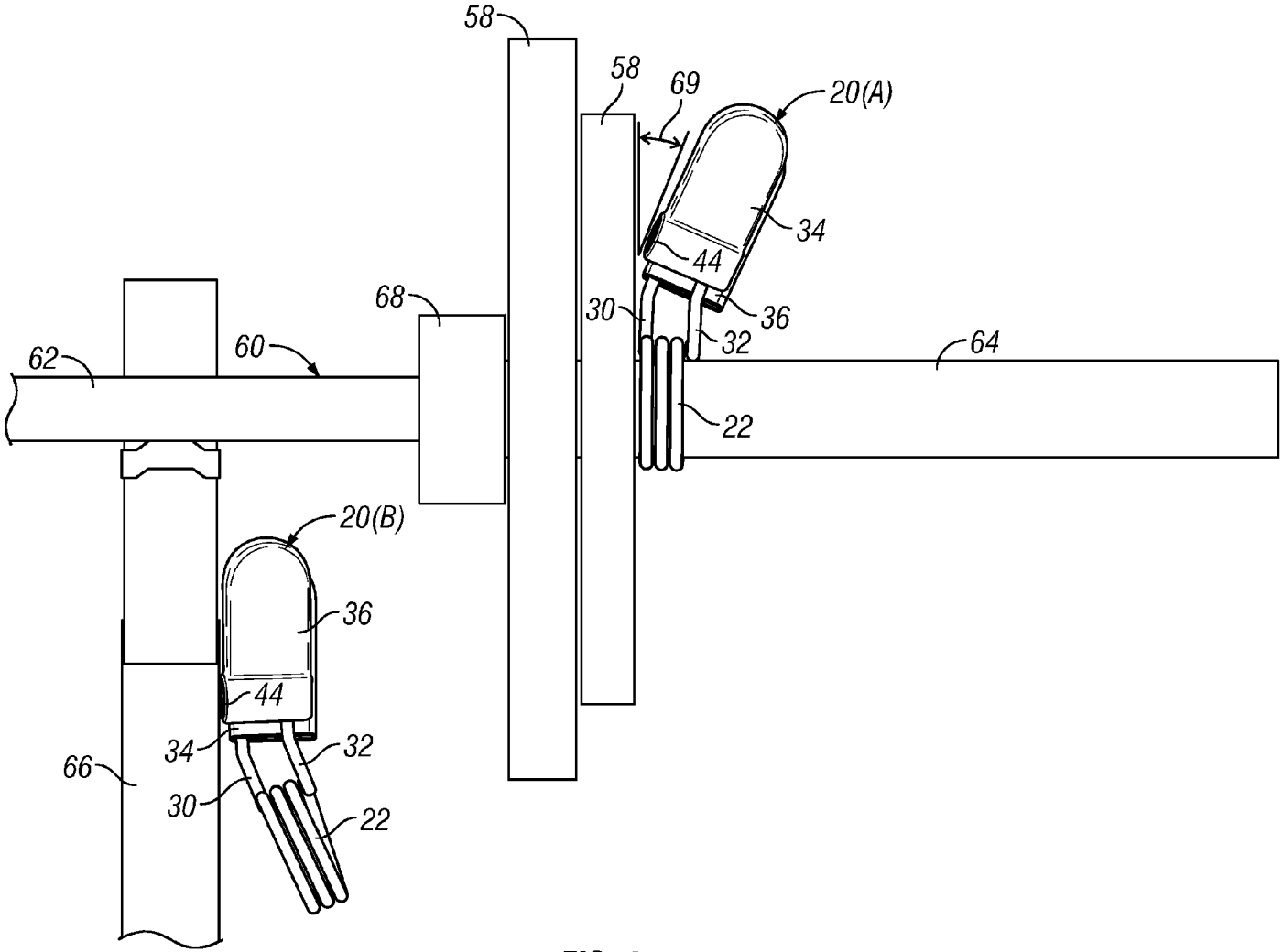
FIG. 4 is an isometric view illustrating one manner in which the spring collar shown in FIGS. 1 and 2 can be utilized to secure a plurality of disc weights to an adjustable-weight barbell (partially shown)

FIG. 4 is an isometric view illustrating one manner in which spring collar 20 may be utilized to secure one or more disc weights 58 to an adjustable-weight barbell 60 (shown in FIG. 4 at 20(A)) and one manner in which spring collar 20 may be magnetically adhered to a ferromagnetic surface when spring collar 20 is not in use (shown in FIG. 4 at 20(B)). In this particular example, barbell 60 assumes the form of an Olympic bar (partially shown) including an elongated, straight grip portion 62 having first and second cylindrical sleeves 64 attached to opposing ends thereof (only one sleeve 64 is shown in FIG. 4 and discussed below for clarity). When not in use, barbell 60 is supported by two support posts 66 (again, only one of which is shown in FIG. 4), which may be included within a bench press, a military press, or a similar piece of exercise equipment. As is common in the context of fitness equipment, support posts 66 are formed from a ferromagnetic material, such as steel, having a relatively high magnetic permeability.

A user brings adjustable-weight barbell 60 to a desired weight by loading a selected number and type of disc weights 58 onto sleeve 64. In the exemplary scenario illustrated in FIG. 4, two disc weights 58 are successively loaded onto sleeve 64 such that the inner face of the first disc weight 58 loaded onto sleeve 64 (the leftmost weight 58 in the illustrated orientation) abuts a cylindrical flange 68 adjacent the inner end of sleeve 64, and the inner face of the second disc weight 58 loaded onto sleeve 64 (the rightmost weight 58 in the illustrated orientation) abuts the outer face of the first disc weight 58. After adding a desired number and type of disc weights 58 to adjustable-weight barbell 60, the user then secures disc weights 58 in place utilizing spring collar 20 by: (i) squeezing radial arms 30 and 32 toward one another to deflect coiled body 22 and increase the diameter of aperture 28 (FIG. 1), (ii) sliding coiled body 22 over sleeve 64 and positioning leading face 24 of coiled body 22 against the outermost disc weight 58, and (iii) releasing arms 30 and 32 to permit coiled body 22 to contract toward the non-deflected state (FIGS. 1 and 2) and thereby frictionally engage an outer circumferential surface of sleeve 64.

As noted above, disc magnet 42 enables spring collar 20 to be stored on a piece of exercise equipment when spring collar 20 is not in use. In so doing, disc magnet 42 increases user convenience by enabling a user to temporarily set aside spring collar 20 at a convenient elevated location, and thus free both hands, when loading or unloading relatively heavy discs weights from an adjustable-weight barbell, such as barbell 60. It is thus desirable for disc magnet 42 to be positioned on spring collar 20 at a location that allows a user to magnetically adhere disc magnet 42 to a ferromagnetic surface (e.g., a sidewall of support post 66) with relative ease while gripping collar 20. At the same time, it is generally desirable to minimize magnetic attraction or "sticking" of disc magnet 42 to an adjacent disc weight to facilitate user removal of spring collar 20 from the barbell's sleeve after use. Therefore, in a preferred group of embodiments, disc magnet 42 is mounted to spring collar 20 at a location wherein magnet 42 is substantially magnetically isolated from an adjacent disc weight (i.e., exerts little to no magnetic pull force on the disc weight) when the disc weight is contacted by spring collar 20. More specifically, and as indicated in FIG. 2, disc magnet 42 is preferably set-back or recessed from the leading plane of spring collar 42 (represented in FIG. 2 by dashed line 48). When set-back from the leading plane of spring collar 42 in this manner, disc magnet 42 will be laterally offset or separated from the outer annular face of the outermost disc weight 58 by an air gap when spring collar 20 is positioned over sleeve 64 and in abutment with disc weight 58, as indicated in FIG. 4 at 69. In this manner, undesired magnetic attraction between magnet 42 and disc weight 58 is minimized when spring collar 20 is positioned on sleeve 64. To further magnetically isolate disc magnetic 42 from outermost disc weight 58, disc magnet 42 may also be angled with respect to the leading plane of spring collar 20; e.g., as shown in FIGS. 1-4, the major leading face of disc magnet 42 may form an angle with the leading plane of spring collar 20 greater than approximately 10 degrees.

Figure 5:
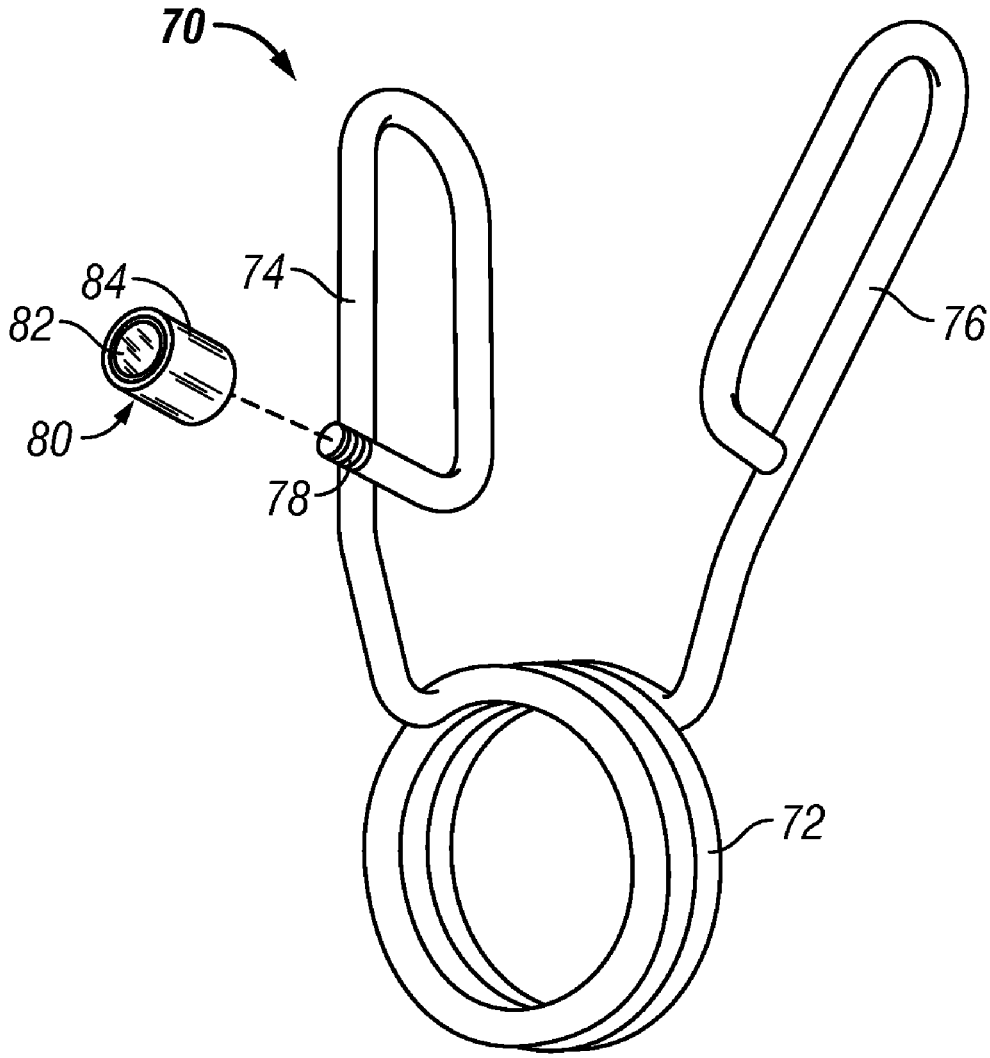
FIG. 5 is an exploded view of a spring collar having an arm-mounted permanent magnet in accordance with a further exemplary embodiment.

The foregoing has thus provided an exemplary embodiment of spring collar including a permanent magnet that enables the spring collar to be removably secured to a ferromagnetic surface when not in use. In the above-described embodiment, the permanent magnet was mounted to a radial arm of the spring collar via attachment to a cover. In further embodiments, the permanent magnet or magnets may be mounted, either directly or indirectly, to one or both of the spring collar's radial arms utilizing other attachment means. FIG. 5 is an isometric view illustrating a spring collar 70 in accordance with a second exemplary embodiment. Spring collar 70 includes coiled body 72; a leading radial arm 74, which extends radially outward from a first end of coiled body 72; and a trailing radial arm 76, which extends radially outward from a second, opposing end of coiled body 72 and which is angularly spaced from leading radial arm 74. Leading radial arm 74 further includes a forward-extending wire segment 78, which extends toward and terminates proximate the leading plane of spring collar 70. A magnetic assembly 80, which includes a permanent cylindrical magnet 82 disposed within a tubular metal casing 84 (commonly referred to as a "pot-type" magnetic assembly), is affixed to the leading end of forward-extending wire segment 78. Magnetic assembly 80 can be affixed to wire segment 78 utilizing, for example, crimping, welding, or soldering techniques. Alternatively, as indicated in FIG. 5, forward-extending wire segment 78 can be threaded and may matingly engage a threaded opening provided in the backside of casing 84 (hidden from view in FIG. 5).

Figure 7:
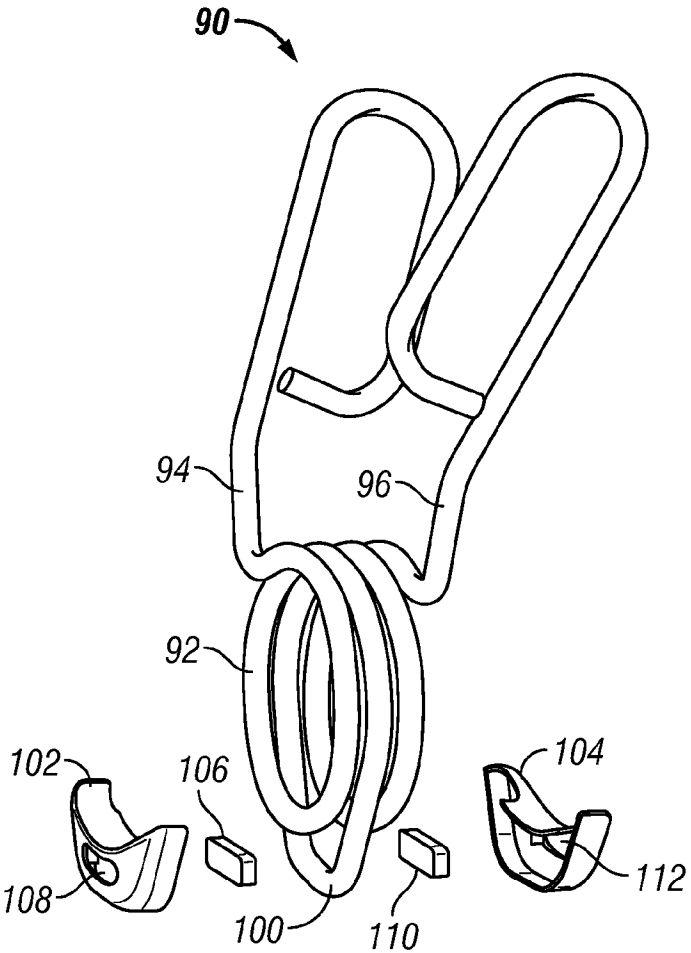
FIGS. 6 and 7 are isometric and exploded views, respectively, of spring collar including a body-mounted permanent magnet in accordance with a further exemplary embodiment.
Figure 6:
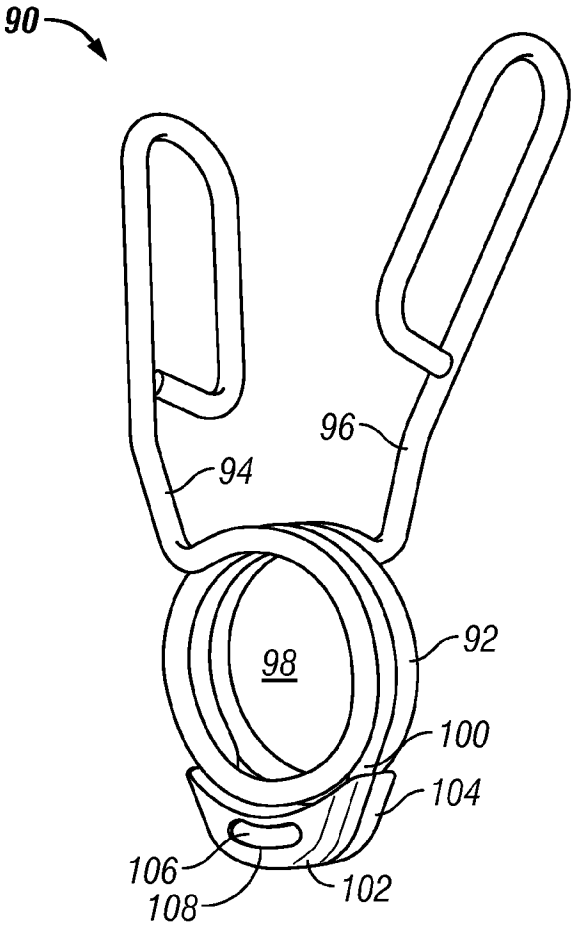

While, in the above-described exemplary embodiments, at least one permanent magnet was mounted to the radial arm of a spring collar, one or more permanent magnets can be mounted to various other portions of the spring collar in further embodiments. Moreover, the spring collar may include additional structural features not included in conventional spring collars to facilitate the mounting of the permanent magnet or magnets. Further emphasizing this point, FIGS. 6 and 7 are isometric and exploded views, respectively, of a spring collar 90 in accordance with a further exemplary embodiment. In many respects, spring collar 90 is similar to spring collar 20 described above in conjunction with FIGS. 1-4. For example, spring collar 90 includes a leading radial arm 94, a trailing radial arm 96, and a coiled body 92 having a central aperture 98 therethrough. However, in contrast to spring collar 20, spring collar 90 further includes an auxiliary radial projection 100 (FIG. 7), which protrudes radially outward from coiled body 92. In the illustrated example, auxiliary radial projection 100 assumes the form of a curved or U-shaped wire segment integrally formed with a lower region of coiled body 92 substantially opposite radial arms 94 and 96. A housing assembly 102, 104 is fixedly coupled to radial projection 100. More specifically, radial projection 100 is physically captured between first and second housing members 102 and 104, which are joined together over radial projection 100 to form housing assembly 102, 104. The manner in which housing members 102 and 104 are joined over radial projection 100 will vary amongst different embodiments; however, by way of example, housing members 102 and 104 can be joined over radial projection 100 utilizing snap-fit features (e.g., internal latch/clip closures molded into member 102 and/or member 104), fasteners (e.g., screws), ultrasonic welding, or heat-staking. In one specific embodiment wherein housing members 102 and 104 are produced (e.g., stamped) from a metal or alloy, housing assembly 102, 104 can be formed as a unitary, hinged clamshell that is bent or crimped around auxiliary radial projection 100 during assembly.

At least one permanent magnet is disposed within housing assembly 102, 104. In the exemplary embodiment shown in FIGS. 6 and 7, specifically, first and second block magnets 106 and 110 are mounted within housing members 102 and 104, respectively. That is, first block magnet 106 is retained between an inner wall of housing member 102 and the leading face of auxiliary radial projection 100; and second block magnet 110 is retained between an inner wall of housing member 104 and the trailing face of auxiliary radial projection 100. As shown in FIGS. 6 and 7, a first window 108 is provided through a leading face of housing member 102 to expose first block magnet 106. Similarly, as shown most clearly in FIG. 7, a second window 112 can be provided through a trailing face of housing member 104 to expose, and thereby minimize the magnetic shield of, second block magnet 110. In certain embodiments, permanent magnet 106 and housing member 102 may be set-back from the leading plane of spring collar 90 to minimize magnetic attraction to adjacent disc weights and thereby facilitate user removal of spring collar 90 from the sleeve of a barbell, as previously described. Collectively, block magnets 106 and 108 enable spring collar 90 to be magnetically adhered to a ferromagnetic surface, such as the steel sidewall of a piece of exercise equipment, when spring collar 90 is not in use.

Figure 9:
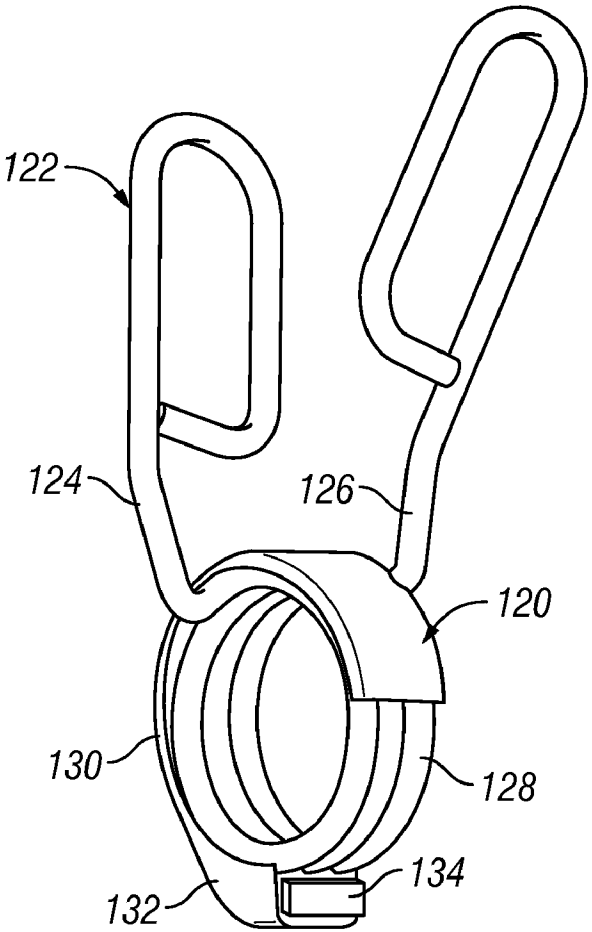
FIGS. 8 and 9 are isometric and cutaway views, respectively, of an elastomeric sleeve having a permanent magnet embedded therein and disposed around the coiled body of a spring collar in accordance with a further exemplary embodiment.
Figure 8:
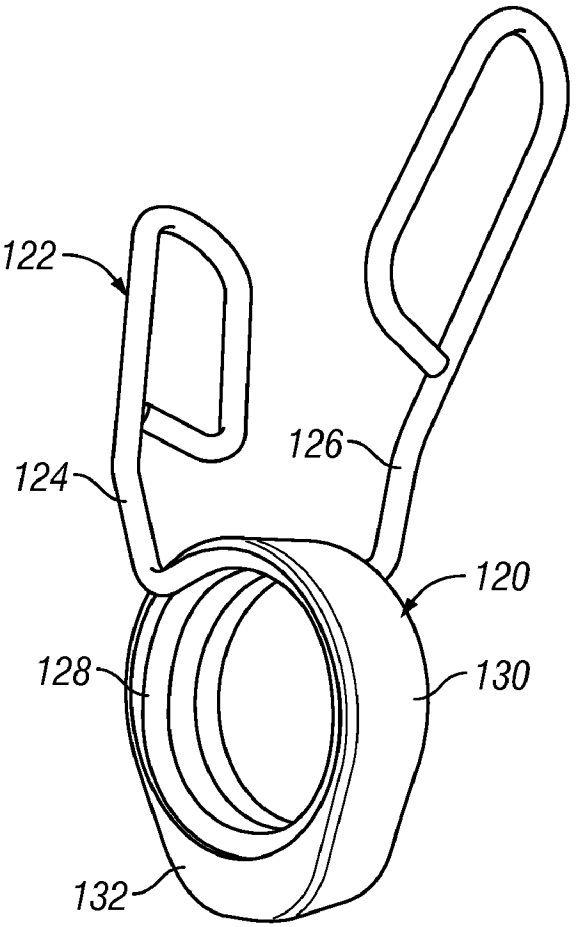
Figure 10:
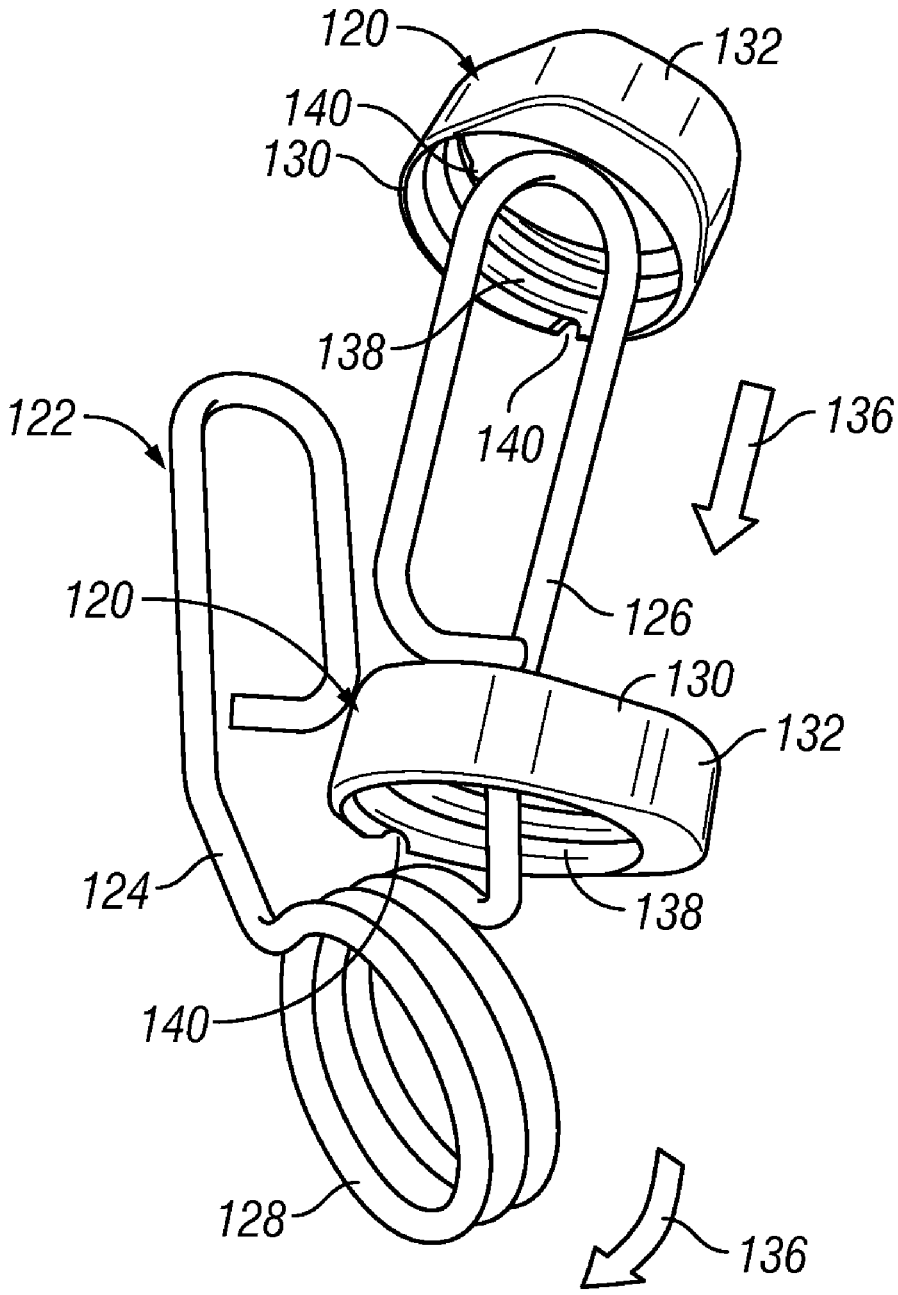
FIG. 10 is an isometric view illustrating one manner in which the elastomeric sleeve can be installed over the spring collar shown in FIGS. 8 and 9.

FIGS. 8, 9, and 10 are isometric views of an elastomeric sleeve 120 and a spring collar 122 having leading radial arm 124, a trailing radial arm 126, and a coiled body 128 in accordance with a further embodiment of the present invention. Elastomeric sleeve 120 includes an annular band 130, which is sized and shaped to be disposed around coiled body 128; a radial bulge 132, which extends radially outward from a lower portion of annular band 130; and a block magnet 134, which is embedded within radial bulge 132 (shown in FIG. 9). Annular band 130 and radial bulge 132 are preferably integrally formed from an elastomeric material that is sufficiently flexible to accommodate the deflection of spring collar 122 and to permit sleeve 120 to be stretched around coiled body 128 during retrofit installation on spring collar 122 (indicated in FIG. 10 by arrows 136). To help maintain the position of sleeve 120 over coiled body 128, annular band 130 may include a tacky, ribbed inner surface 138 that generally conforms with the turns of coiled body 128 (shown most clearly in FIG. 10). In addition, annular band 130 may include first and second notches 140, which accommodate radial arms 124 and 126, respectively, when annular band 130 is properly positioned over coiled body 128. When elastomeric sleeve 120 is installed over spring collar 122, block magnet 134 enables spring collar 122 to be removably secured to a ferromagnetic surface when collar 122 is not in use to provide the benefits noted above.

It should thus be appreciated that there has been provided multiple exemplary embodiments of a spring collar including at least one permanent magnet that enables a user to removably secure the spring collar to a ferromagnetic surface (e.g., the sidewall of a steel beam included within a bench press or other piece of exercise equipment) when the spring collar is not in use. Advantageously, in the above-described exemplary embodiments, the spring collar can be removably secure the spring collar to a piece of exercise equipment in a visually prominent manner to encourage usage of the spring collar by subsequent users within a commercial gym. In addition, the above-described exemplary spring collars increase user convenience by enabling a user to temporarily store the spring collar against a piece of workout equipment at a convenient location, and thus free both hands, when loading or unloading relatively heavy discs weights from an adjustable-weight barbell.

While described above in the context of multiple exemplary embodiments, it is emphasized that most, if not all, of the above-disclosed features can be combined to yield additional embodiments of the spring collar. For example, an embodiment of the spring collar can be produced wherein a first magnet is mounted to the spring collar's radial arm, either directly (e.g., as described above in conjunction with FIG. 5) or indirectly (e.g., via an intermediary cover as described above in conjunction with FIGS. 1-4), and wherein a second magnet is mounted to the spring collar's coiled body via attachment to an auxiliary radial projection as described above in conjunction with FIGS. 6 and 7. Such features are therefore not mutually exclusive in the context of the present disclosure.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended claims.

What is claimed is:

1. A spring collar for removably securing a disc weight to the sleeve of a barbell, the spring collar comprising:

a resilient wire form, comprising:

a coiled body having a central aperture therethrough; and first and second radial arms extending from the coiled body and movable toward one another to increase the diameter of the central aperture and permit a user to slide the coiled body over the sleeve; and a permanent magnet mounted to the resilient wire form and positioned such that, when the spring collar is brought into contact with a ferromagnetic surface by a user, the permanent magnet magnetically adheres the spring collar to the ferromagnetic surface to secure the spring collar against the ferromagnetic surface when the spring collar is not in use.

2. A spring collar according to claim 1 wherein the permanent magnet is set-back from the leading plane of the resilient wire form.

3. A spring collar according to claim 2 wherein the permanent magnet is angled with respect to the leading plane of the resilient wire form.

4. A spring collar according to claim 2 wherein the permanent magnet is laterally separated from the disc weight by an air gap when the resilient wire form is positioned over the sleeve and in abutment with the disc weight.

5. A spring collar according to claim 1 further comprising a cover disposed over the first radial arm, the permanent magnet mounted to the cover.

6. A spring collar according to claim 5 wherein the cover comprises a mounting structure to which the permanent magnet is affixed.

7. A spring collar according to claim 6 wherein the permanent magnet is recessed within the mounting structure.

8. A spring collar according to claim 6 wherein the mounting structure is disposed on a leading edge portion of the cover.

9. A spring collar according to claim 1 wherein the resilient wire form further comprises a radial extension coupled to the coiled body and spaced apart from the first and second radial arms, the permanent magnet mounted to the radial extension.

10. A spring collar according to claim 9 wherein the radial extension comprises a curved wire segment integrally formed within the coiled body.

11. A spring collar according to claim 9 further comprising a housing fixedly coupled to the radial extension, the permanent magnet disposed at least partially within the housing.

12. A spring collar for removably securing a disc weight to the sleeve of a barbell, the spring collar comprising:

a permanent magnet;

a resilient wire form, comprising:

a coiled body having a central aperture therethrough; and first and second radial arms extending from the coiled body and movable toward one another to increase the diameter of the central aperture and permit a user to slide the coiled body over the sleeve; and means for mounting the permanent magnet to the resilient wire form at a location laterally offset from the disc weight by an air gap when the spring collar is positioned over the sleeve and in abutment with the disc weight;

wherein the permanent magnet is positioned such that, when the spring collar is brought into contact with a ferromagnetic surface by a user, the permanent magnet magnetically adheres the spring collar to the ferromagnetic surface to secure the spring collar against the ferromagnetic surface when the spring collar is not in use.

13. A spring collar for removably securing a disc weight to the sleeve of a barbell, the spring collar comprising:

a coiled body having a central aperture therethrough;

first and second radial arms extending from the coiled body and movable toward one another to increase the diameter of the central aperture and permit a user to slide the coiled body onto and off of the sleeve; and a permanent magnet mounted to one of the group consisting of the coiled body and the first radial arm, the permanent magnet set-back from the leading plane of the spring collar and positioned such that, when the spring collar is brought into contact with a ferromagnetic surface by a user, the permanent magnet magnetically adheres the spring collar to the ferromagnetic surface to removably secure the spring collar to the ferromagnetic surface when the spring collar is not in use.

14. A spring collar according to claim 13 further comprising a cover disposed over the first radial arm, the permanent magnet mounted to the cover proximate a leading edge portion thereof.

* * * * *